US010494911B2

(12) United States Patent
Harding et al.

(10) Patent No.: US 10,494,911 B2
(45) **Date of Patent: *Dec. 3, 2019**

(54) PLUNGER LIFT STATE ESTIMATION AND OPTIMIZATION USING ACOUSTIC DATA

(71) Applicant: KELVIN INC., Portola Valley, CA (US)

(72) Inventors: Peter Harding, Portola Valley, CA (US); Logan Duffy, San Francisco, CA (US); Adam Guetz, Mountain View, CA (US); Niall Wells, San Francisco, CA (US); David Bangor, Diamond Bar, OK (US)

(73) Assignee: KELVIN INC., San Francisco, CA (US)

( * ) Notice: Subject to any disclaimer, the term of this patent is extended or adjusted under 35 U.S.C. 154(b) by 34 days.

This patent is subject to a terminal disclaimer.

(21) Appl. No.: 15/877,231

(22) Filed: Jan. 22, 2018

(65) Prior Publication Data

US 2019/0024497 A1 Jan. 24, 2019

Related U.S. Application Data

(63) Continuation of application No. 15/135,888, filed on Apr. 22, 2016, now Pat. No. 9,903,193.

(51) Int. Cl.
*E21B 47/00* (2012.01)
*E21B 43/12* (2006.01)
(Continued)

(52) U.S. Cl.
CPC ..... *E21B 47/0008* (2013.01); *E21B 43/127* (2013.01); *E21B 47/0007* (2013.01);
(Continued)

(58) Field of Classification Search
None
See application file for complete search history.

(56) References Cited

U.S. PATENT DOCUMENTS 4,934,186 A 6/1990 McCoy
5,105,671 A 4/1992 Slater
(Continued)

FOREIGN PATENT DOCUMENTS

WO 2015127339 A1 8/2015

OTHER PUBLICATIONS

International Search Report and Written Opinion dated Jan. 29, 2018 in PCT/US17/58858.
(Continued)

*Primary Examiner* — Andre J Allen
(74) *Attorney, Agent, or Firm* — Young Law Firm, P.C.

(57) ABSTRACT

A computer-implemented method may comprise attaching a plurality of wireless sensors to a pump jack; receiving time-stamped data from at least some of the plurality of wireless sensors attached to the pump jack, at least one of the plurality of wireless sensors comprising an accelerometer and a gyroscope and being attached to a crank arm of the pump jack; synchronizing the received time-stamped data; from the synchronized time-stamped data, calculating and generating information related to: a downhole load versus polished rod position of the pump jack; a relative balance of a counterweight of the pump jack relative to a horse head of the pump jack; deviations from a nominal acceleration profile of a bridle of the pump jack; and an angle of inclination of the bridle of the pump jack; and selectively generating, on a computing device, visualizations of the generated information.

20 Claims, 12 Drawing Sheets

(51) Int. Cl.
*F04B 51/00* (2006.01)
*F04B 47/02* (2006.01)
*F04B 17/03* (2006.01)

(52) U.S. Cl.
CPC ..... *F04B 17/03* (2013.01); *F04B 47/028* (2013.01); *F04B 51/00* (2013.01); *E21B 2043/125* (2013.01)

(56) References Cited

U.S. PATENT DOCUMENTS

| | | | | |
|---|---|---|---|---|
| 5,735,170 | A | 4/1998 | Bales et al. | |
| 6,241,014 | B1 | 6/2001 | Majek et al. | |
| 6,634,426 | B2 | 10/2003 | McCoy et al. | |
| 7,445,048 | B2 | 11/2008 | Sheffield | |
| 7,963,326 | B2 | 6/2011 | Giacomino | |
| 8,616,288 | B1 | 12/2013 | Byrne | |
| 9,903,193 | B2 * | 2/2018 | Harding | E21B 47/0008 |
| 2004/0124012 | A1 | 7/2004 | Dunlop et al. | |
| 2005/0155759 | A1 | 7/2005 | Bramlett et al. | |
| 2008/0162058 | A1 | 7/2008 | Baklanov et al. | |
| 2010/0101774 | A1 | 4/2010 | Ocondi | |
| 2011/0112997 | A1 | 5/2011 | Sabe | |
| 2012/0185220 | A1 | 7/2012 | Shippen | |
| 2013/0108472 | A1 | 5/2013 | Pons | |
| 2013/0306326 | A1 * | 11/2013 | Doyle | E21B 43/127 166/369 |
| 2014/0090837 | A1 | 4/2014 | Hedtke et al. | |
| 2014/0102698 | A1 | 4/2014 | Bergman | |
| 2014/0114550 | A1 | 4/2014 | Bohr et al. | |
| 2015/0090445 | A1 | 4/2015 | Miller et al. | |
| 2015/0300156 | A1 * | 10/2015 | Mills | E21B 47/0007 73/152.61 |
| 2016/0061012 | A1 | 3/2016 | Zimmerman, Jr. | |
| 2017/0030348 | A1 * | 2/2017 | Mills | E21B 43/121 |
| 2017/0152737 | A1 | 6/2017 | Pons | |
| 2017/0306745 | A1 * | 10/2017 | Harding | E21B 47/0008 |
| 2018/0340402 | A1 * | 11/2018 | Michel | E21B 43/127 |

OTHER PUBLICATIONS

USPTO Notice of Allowance dated Oct. 20, 2017 in U.S. Appl. No. 15/135,888.

Analyzing & Troubleshooting Plunger Lifted Wells, Red Griffin, Lynn Rowlan, Gas Well De-Liquification Workshop, Denver Colorado, Feb. 28-Mar. 2, 2005.

Liquid and Gas Flow Monitoring in Plunger Lift, Wayne Hill, Nicholas Lima, Gas Well De-Liquification Workshop, Denver Colorado, Feb. 23-25, 2015.

Echometer Digital Well Analyzer brochure MS1913-001 Rev B, Dec. 1, 2008.

Well Analyzer and TWM Software Operating Manual, Echometer Company, MS 1900 REV D, Oct. 9, 2008.

Echometer Plunger tracking and Fluid-Level Measurement, (C) 2008 Weatherford International Ltd.

* cited by examiner

200

400

500

600

600

600

900

1000

PLUNGER LIFT STATE ESTIMATION AND OPTIMIZATION USING ACOUSTIC DATA

BACKGROUND

A pump jack (also called oil horse, donkey pumper, rocking horse, beam pump, and jack pump, among other names) is the over-ground drive for a reciprocating piston pump in an oil well. Pump jacks are designed to mechanically lift liquid out of the well in cases in which insufficient bottom hole pressure exists for the liquid (typically an emulsion of oil and water) to flow to the surface.

A pump jack converts the rotary motion of an electric motor or internal combustion engine to a vertical reciprocating motion to drive the pump shaft. The motor of the pump jack runs a set of pulleys to the transmission, which drives a pair of cranks equipped with counterweights to assist the motor in lifting the heavy string of rods. The cranks raise and lower one end of an I-beam which is free to move on an A-frame or Samson post. On the other end of the beam is a curved metal box called a horse head or donkey head. A cable made of steel (or occasionally, fiberglass) called a bridle, connects the horse head to the polished rod, which is a piston that passes through a stuffing box. The polished rod has a close fit to the stuffing box, letting it move in and out of tubing without fluid escaping. The tubing is a pipe that runs to the bottom of the well through which the liquid is produced. The bridle follows the curve of the horse head as it lowers and raises to create a nearly vertical stroke. The polished rod is connected to a long string of rods called sucker rods, which run through the tubing to the down-hole pump, usually positioned near the bottom of the well.

A well may be lined with cement walls. Within the cement walls is the tubing, the down-hole pumps and the sucker rods. The down-hole pump is located at the bottom of the tubing. On the downward stroke, the plunger of the down-hole pump fills with oil, and on the upward stroke this oil is transported to the top of the well where it is extracted and put into barrels. The down-hole pump has two ball check valves: a stationary valve at bottom called the standing valve, and a valve on the piston connected to the bottom of the sucker rods that travels up and down as the rods reciprocate, known as the traveling valve. Oil-containing fluid enters from the formation into the bottom of the borehole through perforations that have been made through the casing and cement. When the rods at the pump end are traveling up, the traveling valve is closed and the standing valve is open (due to the drop in pressure in the pump barrel). Consequently, the pump barrel fills with the fluid from the formation as the traveling piston lifts the previous contents of the barrel upwards. When the rods begin pushing down, the traveling valve opens and the standing valve closes (due to an increase in pressure in the pump barrel). The traveling valve drops through the fluid in the barrel (which had been sucked in during the upstroke). The piston then reaches the end of its stroke and begins its path upwards again, repeating the process.

Pump jacks are typically used for low-volume marginal or "stripper" wells that produce no more than 15 barrels a day. The average stripper well produces only about 2.2 barrels per day. Depending on the size of the pump jack, anywhere from 5 to 40 liters of liquid may be delivered to the surface with each stroke. Although designed and used for low yield wells, pump jacks service 84 percent of U.S. oil wells and produce, in the aggregate, fully 18 percent of all US domestic oil. Keeping these pump jacks operating at peak performance is, therefore, vitally important. Significantly, it has become clear that early detection of anomalies in the operation of the pump jacks is key to identifying less than optimal operation or indeed predicting impending failure of the jack pump. In turn, such anomaly detection may allow for predictive maintenance to be carried out before failure or significant performance degradation.

DETAILED DESCRIPTION

Unique Performance Signature

Figure 1:
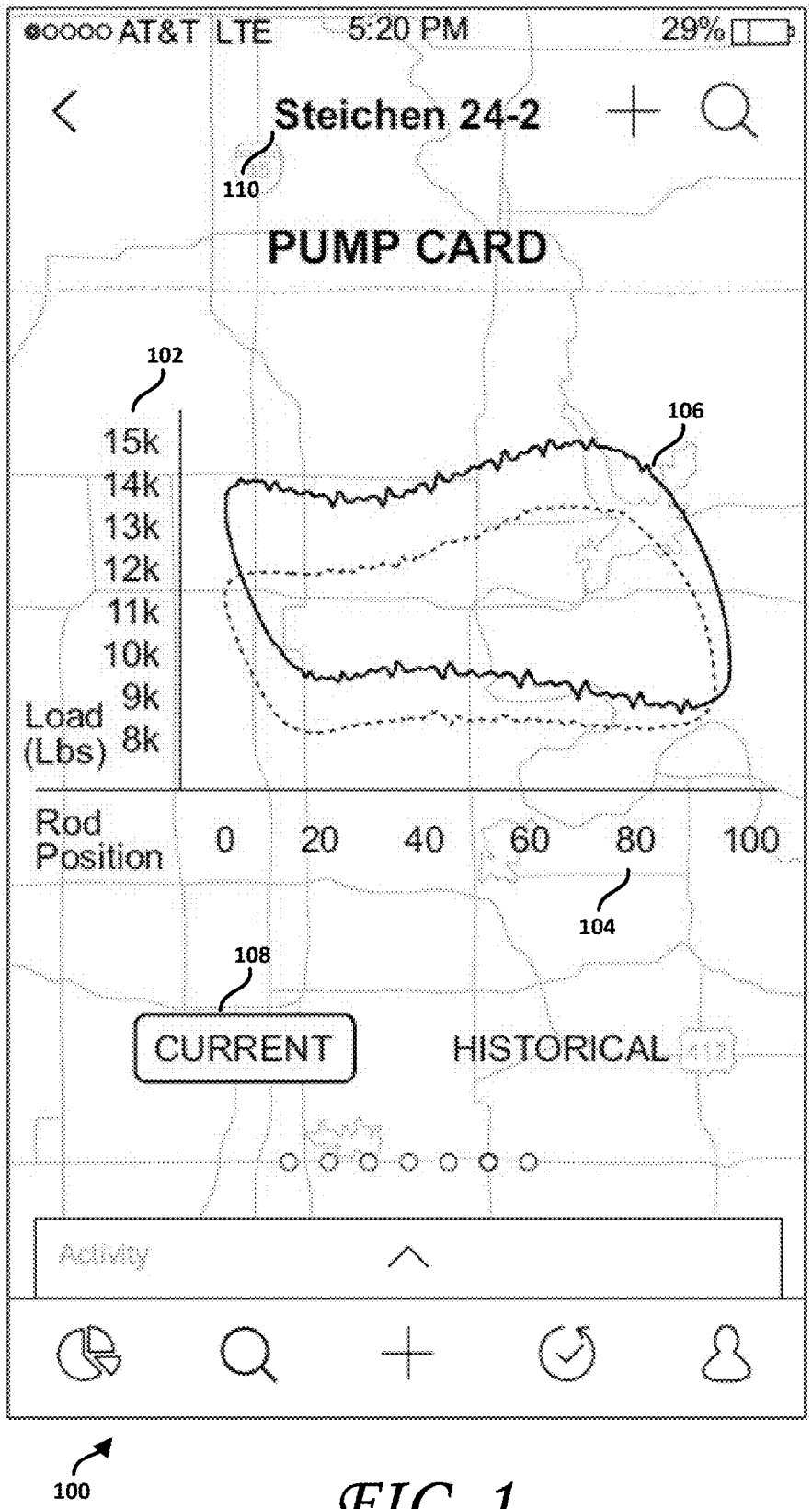
FIG. 1 is a two-dimensional plot representing the "current" calculated down hole load (in lbs. along the vertical axis) plotted against the position of the plunger or rod (in inches along the horizontal axis), as may be visualized on a mobile computing device, according to one embodiment.

One embodiment identifies the unique performance signature of a hardware asset such as a pump jack. This unique performance signature may be obtained through combinations of readings from sensors coupled to or near the hardware asset. These readings may originate from a predetermined set of sensors that may include, for example, accelerometers, gyroscopes, acoustic microphones, accelerometers, pressure sensors, load cells, torque sensors, temperature, flow meters, electrical current meters, to identify but a few of the possible sensors. The unique performance signature may also include processed data obtained from other devices using a communication link. The unique performance signature may also include data recorded or derived from field observations, including questionnaires, video and audio data. According to one embodiment, processed data for the unique performance signature may also be obtained from other sources, such as a pump jack's SCADA (Supervisory Control And Data Acquisition) system, as further described herein below.

According to one embodiment, a sample of these readings may be used to determine a baseline for the nominal performance of the hardware asset. These multiple inputs may then be summarized using Bayesian inference combined with sensor-fusion (the integration of data from a plurality of sensors), machine learning that allow for billions of individual data points to be combined into one or more unique metrics that describe the performance of the pump jack. This baseline unique asset signature may then be used as the basis from which current or historical performance may be compared over time.

K-Score

By observing the behavior of readings from an asset for a period of time, a nominal state of behavior of the asset (such as a pump jack component or subassembly) may be determined, across a set of predetermined key metrics. Once visualized, the shape of these metrics may be compared from one period of time to another and statistical methods may be used to create a similarity score across each of the key metrics. These similarity scores may then be combined to create a single K-score, which corresponds to an estimate of whether the asset has changed by a statistically significant amount between the time intervals.

State Estimation

Given a large number of data (sensor readings, observations, derived metrics) over time from a collection of similar assets, and a set of labels (such as 'normal', 'gas interference', 'tubing leak', etc.) associated with the data, supervised learning techniques (random forests, support vector machines, etc.) may be used to identify the same labels in similar assets.

According to one embodiment, raw data from sensors and other sources may be gathered and applied transformed into actionable information, in the form of one or more graphical representations, which may be delivered to user's computing devices over a local and/or wide area computer network via, for example, a mobile app or a browser-based html interface.

According to one embodiment, the pump card data may be used to generate visualizations of both current and historical pump (dynamometer) card operation. FIG. 1 is a representation of current pump card operation, displayed as a two-dimensional plot 106 representing the current calculated downhole load 102 (in lbs. along the vertical axis) vs. displacement of the polished rod 104 (in inches along the horizontal axis). For a normally operating pump, the shape of this plot (known as a "surface card"), is generally an irregular oblong shape and the area inside of this rectangle is proportional to the work performed by the pump jack. Variations in the shape and surface area of the surface card can be indicative of the functioning of the pump and of characteristics of the fluid being pumped. The pump card, therefore, is a valuable diagnostic tool. The downhole load may be calculated from the output of one or more load or pressure sensors and the polished rod position may be inferred from the acoustical output of one or more microphones and/or from other (e. g., optical) sensors. In obtaining the current calculated pump card 108, data may be taken over, for example, the past 30 minutes. This past 30 minutes may, according to one embodiment, be selected from the moment the pumping unit (from which the pump card is to be generated) is selected and then averaged across each full stroke of the pump. This averaged data is then used to calculate the down hole load vs plunger position for this selected pumping unit. Another pump card 112 may also be displayed, as showed in FIG. 1. This pump card 112 may represent an historical pump card, or the last pump card displayed for this pump jack. This allows an intuitive comparison of the operation, based on the current operation and a selected prior operation.

As shown in FIG. 1, a map background may be present for stylistic purposes only or may dynamically update based upon the geographic coordinates of the pump jack whose pump card information is being displayed. A marker may be displayed to precisely identify the location of the pump jack. The unique name or identifier 110 of the pump jack may also be displayed. As shown, the visualization 100 may be configured for display on a laptop or desktop computer or may be configured for a mobile device such as a tablet or phone.

Figure 2:
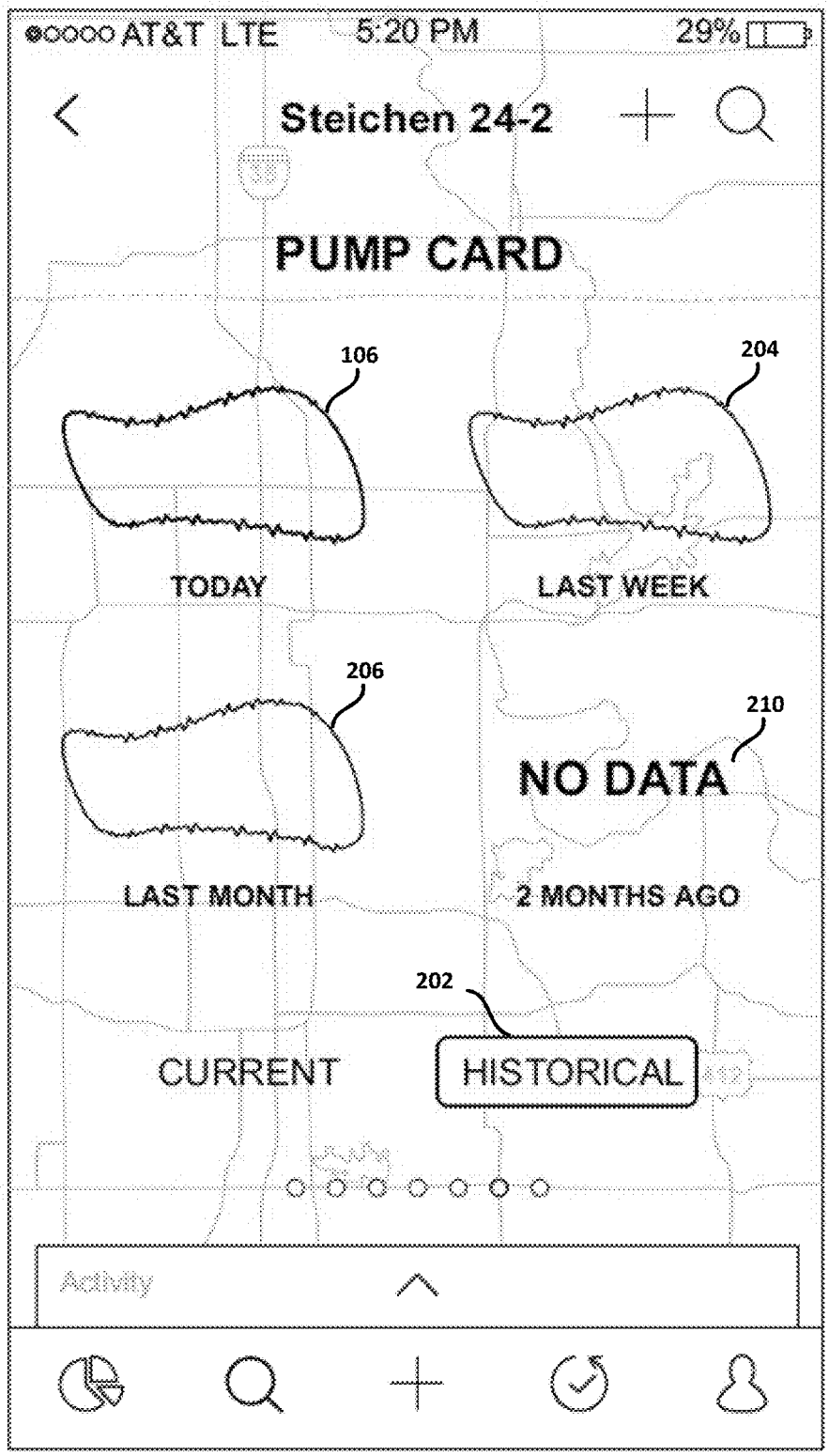
FIG. 2 is a two-dimensional plot representing a historical view of past calculated down hole loads (in lbs. along the vertical axis) plotted against the plunger position (in inches along the horizontal axis), as may be visualized on a mobile computing device, according to one embodiment.

FIG. 2 is a representation 200 of historical pump card operation, also displayed as a two-dimensional plot representing the historical calculated downhole load (in lbs. along the vertical axis) vs. the position of the polished rod (in inches along the horizontal axis), when the HISTORICAL button 202 is selected. In one implementation, the historical view of pump card operation of FIG. 2 may graphically represent pump card operation of earlier the same day as shown at 106, the previous week as shown at 204, the previous month 206 and two months ago, as shown at 210 (no data available, in this case). Other time periods may be selected.

Data Collection and Processing

The data collected and averaged for the pump card calculations visualized in FIGS. 1 and 2, according to one embodiment, may include the Root-Mean-Square (RMS) of the electrical current data acquired through sensors from the electric motor, the crank angle over time, the crank velocity over time, the crank acceleration over time, the pump jack's structural geometry, and the pump jack's American Petroleum Institute (API) specifications. The RMS of the electrical current data may be obtained, in one implementation, from a split core transformer clip-on ammeter measuring the current draw (in amps) of the electric motor. Time series data on the crank angle (theta in radians, $\theta$ in rad), the crank angular velocity (in rad/sec), and the crank angular acceleration (in rad/sec$^2$) may be generated, with a corresponding timestamp, as the crank's phase "cycle" may be estimated using a 6-axis IMU sensor.

Full Stroke of the Pumping Unit

The full stroke of the pumping unit refers to the complete upward and downward motion of the pumping unit. This is also referred to as the upstroke and downstroke of a pump's motion and directly correlates to one full rotation of the crank. Furthermore, the beginning of the stroke starts with the pump at its lowest position and the crank at a 12 o'clock position, then the upstroke motion runs until the pump reaches its highest point and the crank at a 6 o'clock position. Lastly, the downstroke motion runs until the pump returns to its lowest position and the crank is at a 12 o'clock position again.

Inferring Machine Phase from 6-Axis Inertia Measurement Unit (IMU)

One embodiment uses streaming data from accelerometers and gyroscopes to ascertain the state of a machine in relation to its "cycle". Using Principal Components Analysis, the major axis of movement for the machine is located in physical space. In one embodiment, the sensor data is combined to get the crank angular position, angular velocity, and angular acceleration using a 1-D Kalman filter to account for drift and bias and ensure accurate values for the centrifugal acceleration of the machine part. To synchronize the sensors, the phase values are mapped onto the time-stamps returned by the sensors and interpolated to provide continuous values. This enables the determination of which point in the machine phase corresponds to any data reading from any attached sensor.

American Petroleum Institute (API) Specifications

The structural geometry and the pump jack's American Petroleum Institute (API) specifications refers to the physical measurements and rigid body mechanics of the pumping unit. This includes counterweight mass and position on the crank, pitman arm pin position on the crank, stroke length (or the polished rods displacement through half a stroke, i.e. from the bottom to top of the pumps motion), and the structural unbalance (SU), of the pumping unit based on the manufacturer's specifications. These measures enable a "torque factor" to be calculated, which torque factor relates the surface load (the load acting on the pumping unit at the polished rod) and the rod torque. For any given crank angle, the torque factor multiplied by the surface load and structural unbalance difference, gives the torque at the crankshaft of the beam pumping unit speed reducer.

Estimation of Crank Load Using Motor Torque and 6-Axis IMU

To estimate the crank load (CL), information may be collected about the pump jack, including counterweight mass and position on the crank and pitman arm pin position on the crank. The estimate of the crank angular acceleration may then be used to obtain the 'inertial torque' of the crank system. An estimate of motor torque may be derived from either a) an ammeter(s) (clamp or contact-type) measuring the current between the motor and the motor controller in combination with physical and electrical specifications of the motor and gearbox, or b) measurements of motor power/torque from a serial communication with the motor controller. Alternatively, such data may be obtained from the pump jack via the SCADA system, which is a system for remote monitoring and control that operates with coded signals over communication channels (using typically one communication channel per remote station).

Estimation of Surface Load Using Crank Load

To estimate surface load (SL) from crank load (CL), physical information about the pump jack may be collected, including walking beam length and mass, pitman arm length, pitman arm pin position on crank, counterweight position/mass, crank mass. From this information, a 'torque factor' (TF) may be derived that gives a relationship between surface load and crank load (SL=TF*CL). Complications arise from two factors: a) uncertainty in the CL estimate, and b) the TF is 0 at two points in the crank cycle, making the estimate degenerate near these points. To address these issues, a linear model of SL is assumed and a Kalman filter is used to infer SL given CL and TF. Furthermore, with the combination of data sets and geometric specifications, corresponding data sets may be obtained regarding the motion of the walking beams, i.e., the beam's change in angle through a full stroke and its angular acceleration.

Sensor Locations

At least one 6-Axis IMU (accelerometer plus gyroscope) may be attached to the polished rod and is referred to as the bridle sensor. At least one 6-Axis IMU (accelerometer plus gyroscope) may be attached to the pumping unit crank arm and is referred to as the crank sensor. One or more sensors may be provided to monitor motor current and/or a device may be provided that communicates with the motor controller and/or a strain gauge may be provided, to measure crank arm deflection. These may be collectively referred to as the motor power sensor(s). A strain gauge may be provided, to measure beam deflection.

Calculating the Down Hole Load Vs Plunger Position: The Pump Card Calculation

Figure 3A:
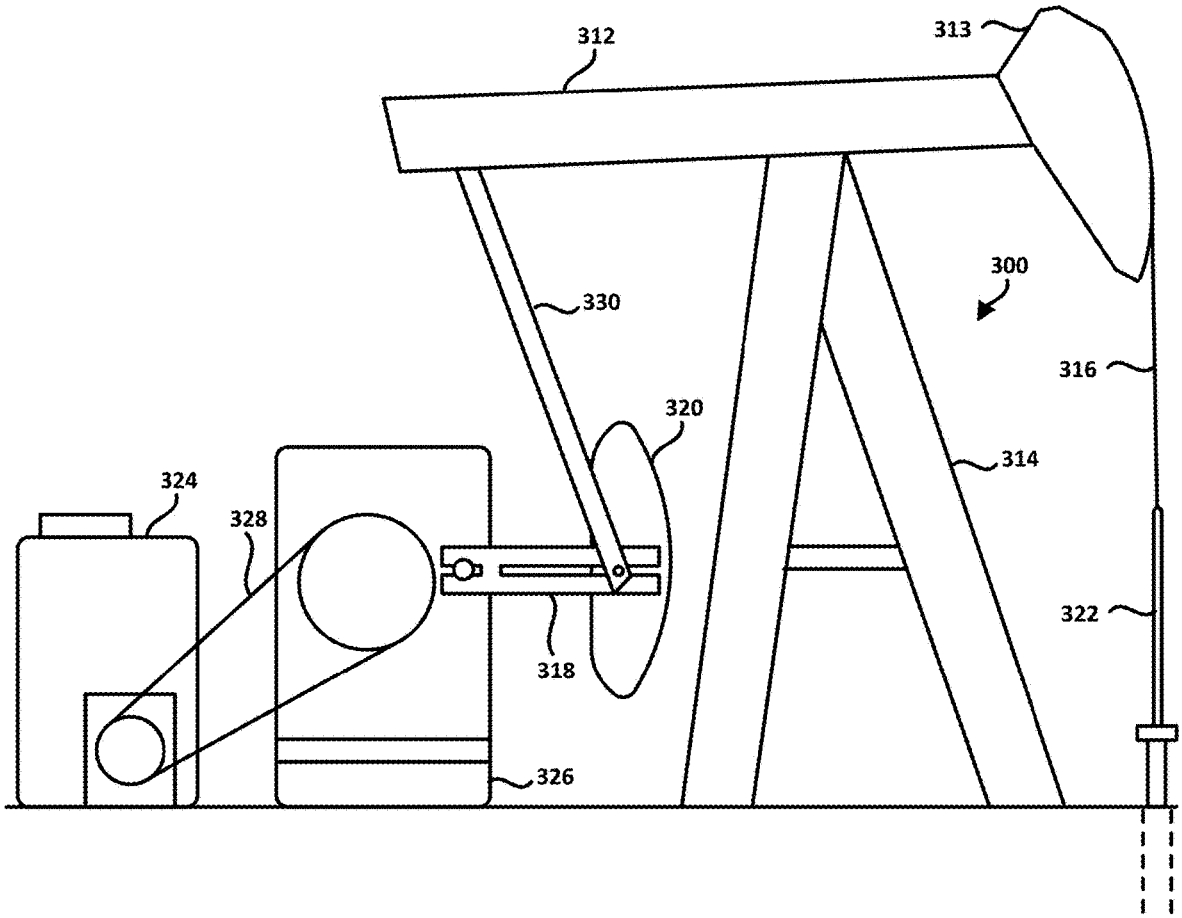
FIG. 3A is a diagram of a pump jack and a system according to one embodiment.

FIG. 3A is a diagram of a beam pump, suitable for use in conjunction with the present embodiments. As shown, FIG. 3A shows a beam pump 300 unit, one or more processors 302 of a computer system, memory 304, a database or repository 306 of sensor data, a computer network 308 (including, for example, a local area network and/or a wide area network such as the internet) and a computing device 310, such as a tablet, computer system or smartphone, configured to process the beam pump sensor data and/or to display the visualizations described herein. The computations underlying the visualizations shown and described herein may be carried out by the computing device 310, by the processor(s) 302, by servers coupled to the network or by a combination thereof. According to one embodiment, the processor(s) 304 may perform the computer-implemented method of FIG. 11, according to computer-readable instructions stored in memory 304 and/or in some other form of non-transitory computer-readable storage medium. Indeed, one embodiment may be such a non-transitory computer-readable storage medium, configured to store computer-readable instructions that, when executed by processor(s) 302, cause the processor(s) 302 to execute the method shown in FIG. 11 and/or exhibit any of the functionality shown and described herein. According to one embodiment, wireless sensors attached to the beam pump 300 may be configured to be accessed wirelessly by the processor 302 and the sensor values gathered thereby downloaded and stored in the database 306. The sensor data may be obtained by polling the sensors or one or more of the sensors themselves may be configured to push data for storage in the database 306.

The beam pump 300 may include a walking beam 312, which may pivot about a pivot point on Samson post 314, thereby causing a rod string or bridle 316, attached to weighted horse head 313, to move up and down in a reciprocating motion. This reciprocating motion actuates a downhole pump at the bottom of the well. The walking beam 312 is caused to pivot about the fulcrum of the Samson post 314 by a crank arm 318 that is coupled to the walking beam 312 via Pitman arm 330. A counterweight 320 balances the horse head 313, the bridle 316 and polished rod 322. A prime mover such as an electric motor 324 coupled to a gear reducer 326 drives the crank arm 318, using a V-belt, as shown at 328.

Figure 3A:
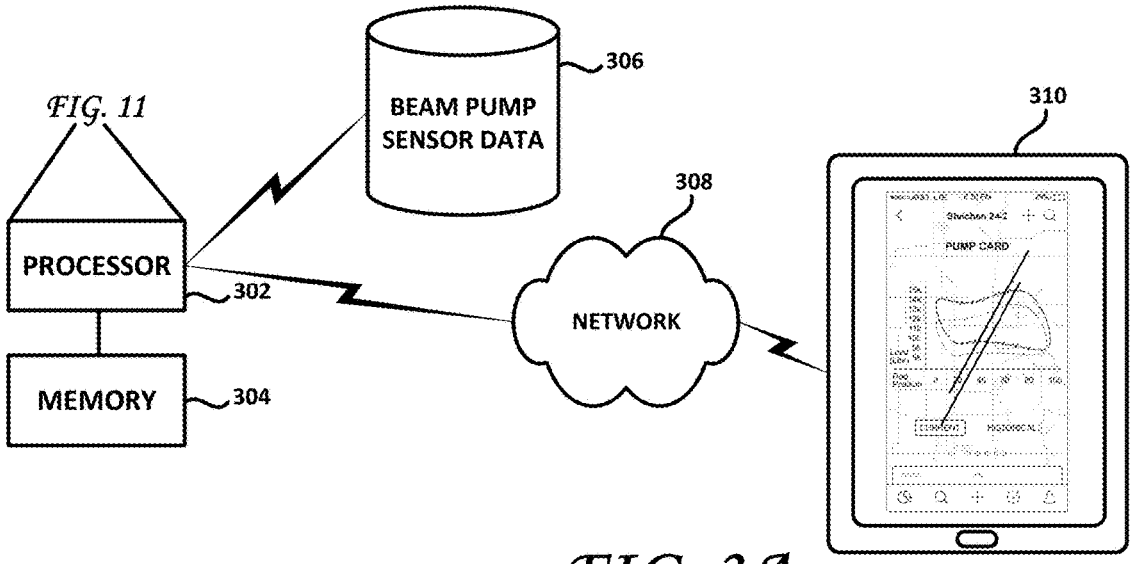
Figure 3B:
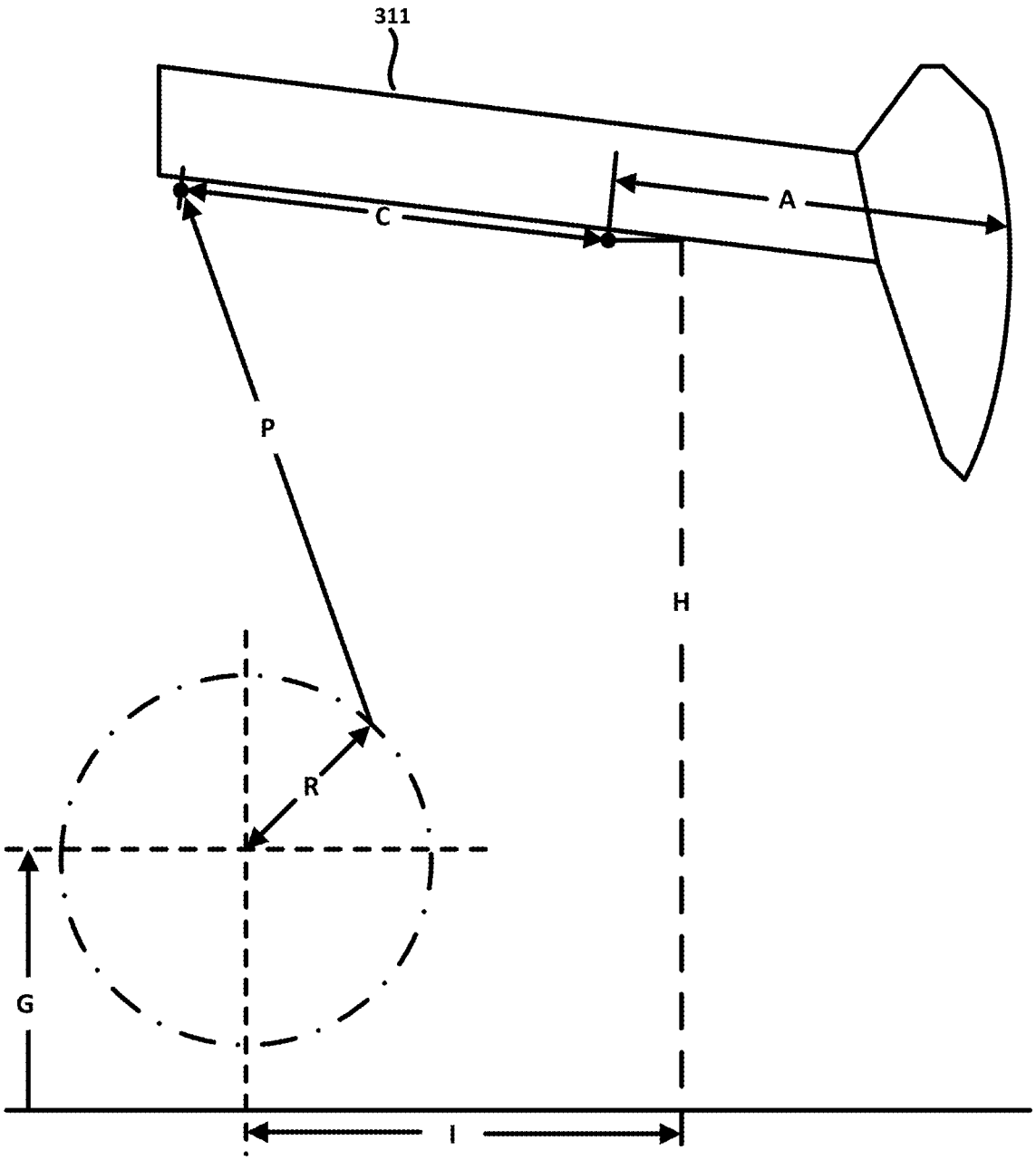
FIG. 3B is a simplified representation of a beam pump, illustrating various values used in calculating, among other quantities, the downhole load vs. plunger position (pump card), according to one embodiment.

FIG. 3B is a simplified representation of a beam pump, illustrating various structural specifications that may be used in calculating the downhole load vs. plunger position (pump card), according to one embodiment. With reference to FIG. 3B, the following structural specifications may be defined and utilized:

A=distance from the center of the saddle bearing to the centerline of the polished rod, in inches (in.);

C=distance from the center of the saddle bearing to the center of the equalizer bearing, in inches;

P=effective length of the pitman arm (from the center of the equalizer bearing to the center of the crankpin bearing), in inches (in.);

H=height from the center of the saddle bearing to the bottom of the base beams, in inches (in.);

R=radius of the crank, in inches (in.);

G=height from the center of the crankshaft to the bottom of the base beams, in inches (in.); and I=horizontal distance between the centerline of the saddle bearing and the centerline of the crank shaft, in inches (in.).

STEP 1: According to one embodiment, using the averaged data of crank angle over time and the structural specifications below and shown in FIG. 3, a "torque factor" data set is calculated, and associated to the averaged data in this time period.

STEP 2: Using the following relationship between the polished rod position ($S_p$, in inches), the max polished rod displacement or stroke length (S, in inches), and the crank angle . . .

$$S_p = \frac{S}{2}(1 - \cos(\theta))$$

. . . the second derivative of this equation with respect to time is taken to obtain the polished rod's acceleration with respect to time, as a function of the crank angle, crank angular velocity, and crank angular acceleration:

$$\frac{d^2S_p}{dt^2} = \frac{S}{2}\left(\cos(\theta)\left(\frac{d\theta}{dt}\right)^2 + \sin(\theta)\left(\frac{d^2\theta}{dt^2}\right)\right)$$

Then, with the use of the direct relationship between the polished rods position and the walking beam's angular position, $\theta_b$ in radians (expressing the fact that the vertical displacement of the polished rod equals to the length of the arc covered by the outward end of linkage A of the pumping unit for a given beam angle) . . .

$$S_p = A\theta_b$$

. . . a direct calculation of the walking beam's angular acceleration may be made, as follows:

$$\frac{d^2\theta_b}{dt^2} = \frac{1}{A}\frac{d^2S_p}{dt^2}$$

STEP 3: Now with the combination of our sensor data, the derived torque factor, the derived beam's angular acceleration, and pumping unit geometric specs, the following net torque equation may be used on the gearbox as the algebraic sum of all possible torque components:

$$T_{net}(\theta) = T_r(\theta) + T_{CB}(\theta) + T_{ia}(\theta) + T_{ir}(\theta)$$

. . . where all torques are determined with respect to the crank angle.

$T_{ir}(\theta)$ represents the rotary inertial torque on the gearbox in in-lbs units.

With the crank angular acceleration $$\frac{d^2\theta}{dt^2},$$

and approximated geometric constant on the net moment of inertia of the rotating system, $C_{ir}$, the rotary inertial torque may be calculated using the equation:

$$T_{ir}(\theta) = \frac{12}{32.2}C_{ir}\frac{d^2\theta}{dt^2}$$

$T_{ia}(\theta)$ represents the articulating inertial torque on the gearbox in in-lbs units. With the beam's angular acceleration, $$\frac{d^2\theta_b}{dt^2},$$

and approximated geometric constant on the net moment of inertia of the structural parts regarding the beam, horses head, equalizer, etc., $C_{ia}$, the articulating inertial torque may be calculated using the equation . . .

$$T_{ia}(\theta) = \frac{12}{32.2}TF(\theta)\frac{C_{ia}}{A}\frac{d^2\theta_b}{dt^2}$$

. . . where $T_{CB}(\theta)$ represents the counterbalance torque in in-lbs units.

With an approximated constant for the maximum moment of inertia on the counter weights and cranks, the counterbalance torque may be calculated by the equation:

$$T_{CB}(\theta) = -C_{CB}\sin(\theta)$$

where $T_{net}(\theta)$ represents the net torque equation on the gearbox in in-lbs units, which may be calculated by multiplying the RMS ammeter data with the approximated gear ratio constant in the manufacturer's brochure. In this manner, the only torque unaccounted for is the $T_r(\theta)$ rod torque measured in in-lbs. However, using an equation relating the sum of all possible torques and given what torques may be calculated, solving for $T_r(\theta)$ yields the following:

$$T_r(\theta) = T_{net}(\theta) - T_{CB}(\theta) - T_{ia}(\theta) - T_{ir}(\theta)$$

Furthermore, the relationship between the rod torque and the surface load, $F(\theta)$, measured in lbs, may be exploited by the equation:

$$T_r(\theta) = TF(\theta)(F(\theta) - SU)$$

Note that the surface load is a measure of the load acting on the pumping unit at the surface of the well and is measured as the load effect on the polished rod.

STEP 4: To make the calculations of surface load, the equation above is solved for $F(\theta)$. However, since all these data sets are with respect to the crank angle, complications arise because the $TF(\theta)$ values are approximately zero at crank angles around 0° and 180°. To address this issue, a Kalman Filter may be applied to the data sets, which is an algorithmic approach designed to estimate conditional probabilities of observing a data value given the previous values. This, in turn, allows the inference of estimates of surface load about positions of 0° and 180° on the crank. However, this does come at a cost of some uncertainty regarding the accuracy of these estimates around these regions.

STEP 5: The final step is translating the surface load information to down hole load information. This may be achieved, for example, by employing the 1-D damped wave equation of T. A. Everitt and J. W. Jennings, to algorithmically approximate the solution to the partial differential equation through central finite differencing. This method incorporates an iteration over the polished rods stroke and, in turn, provides the associated effective loads acting on the well in relation to the position of the plunger down hole. These results may then be displayed as the card pump graphs shown in FIGS. 1 and 2, representing 2-dimensional plots of the down hole load vs. plunger position.

Obtaining Crank Motion Data from a 6-Axis IMU Sensor

The following details the manner in which crank motion data (e.g., crank angle over time, crank velocity over time and crank acceleration over time) may be obtained. A non-invasive attachment of an enclosure containing wireless enabled sensors may be enabled using metal mounting plates and magnets configured to rapidly and securely attach to various ferrous surfaces of a pump jack. The magnets also enable a rapid and easy removal of the sensors when desired. Once securely attached, data from the sensors can be used to provide feedback on the machine performance. The metal mounting plates, according to one embodiment, may be custom-shaped such that they allow secure non-slipping attachment of the sensor box assembly to any part of the machine, even as the machine (e.g., pump jack) moves. The metal mounting plates also allow attachment of the magnets to the enclosures without compromising the waterproof nature of the enclosures, if waterproof enclosures are used. Using such sensors, accelerometer and gyroscope time series data associated to the rotational movement of the cranks may be obtained. The following steps may then be carried out on the sensor raw data to calculate a detailed description of the crank's motion data.

The first step is to "calibrate" the data coming off the pumping unit's cranks, to characterize the physical space of the pumping unit. Because pump jacks are rigid body machines, the system may be simplified by working specifically in the crank's vertical plane of rotation. This may be carried out, according to one embodiment, by computing a singular value decomposition of the accelerometer matrix data, centered along its respective axes, and using its principal components that define the planar x-y space of the data. Then, with sensor data taken with respect to this plane of rotation, the initial crank angle time series data may be computed.

Next, this initial crank angle time series data may be used to further understand the crank motion by specifically finding where the 0° and 180° positions lie in the plane of rotation. By applying a GAM (Generalized Additive Model) smoothing to the magnitude of the accelerometer vectors as a function of the initial crank angle time series data, the angle associated to the minimum accelerometer vector may be found and used to determine what part of the principal components lie in the upward direction, with respect to the plane of rotation. We denote this 0° position of the crank as the "up vector" in the plane of rotation and by simply rotating the "up vector" by 90° or $\pi/2$, the 90° position of the crank may be obtained, which may be denoted as the "right vector" in the plane of rotation.

Now with the plane of rotation better characterized, the calculation of the crank angle time series data may be refined with the use of a sensor fusion approach, combining sensor data from the accelerometers and gyroscopes. To do this, the accelerometer data may be used and the angle of rotation (in radians) may be computed with respect to the "up vector" and "right vector" in the plane of rotation. Looking at the normal vector to the plane of rotation, the crank angle velocity about this vector may be computed with the gyroscope data. Lastly, these two data sets may be combined and a 1-D Kalman filter may be applied, to account for drift and bias and to ensure accurate time series data on the motion of the cranks. The final result provides accurate crank angle and crank angle velocity time series data, which may be used in further pumping unit analytics.

The crank angle and crank angle velocity data values may be used to generate stroke percentage and stroke rate, respectively. The stroke percentage is desired because it is desired to use the direct relationship between one full rotation of the crank and one full stroke (upstroke and downstroke) of the pumping unit, to maintain the data in line with another fundamental movement of the machine. This is a simple translation obtained by the following product . . .

$$S_{\%} = \frac{\theta}{2\pi} \cdot 100$$

. . . where the resultant stroke percentage is an actual percentage.

Furthermore, by the direct relationship between the crank rotations and the full strokes of the pumping unit, the crank angle velocity data may be translated to a stroke rate because of industry standards of measuring strokes per minute (SPM):

$$\text{stroke rate} = \frac{\text{crank angle } vel}{2\pi} \cdot \frac{1}{60}$$

The final steps are to synchronize the sensor data by mapping the stroke percentage and stroke rate values onto evenly spaced timestamps returned by the sensors, then interpolate and compute the stroke rates derivative.

By selecting stroke percentage data corresponding to stroke rate data under a conditional minimum requirement, the data sets may be paired up according to their cyclic nature and their unique phase patterns identified. Then, the two data sets may be interpolated and a smoothing filter applied to remove the unnecessary noise. Lastly, a derivative may be applied to the synced and smoothed stroke rate data to obtain information on the cranks angular acceleration. In this manner, the following synchronized data may be obtained:

- Stroke percentage, which is directly correlated to crank arm's angular orientation;
- Stroke rate, which is directly correlated to the crank arm's angular velocity; and
- Stroke rates rate of change, which is directly correlated to crank arm's angular acceleration.

Pumping Unit Balance Estimation

Figure 4:
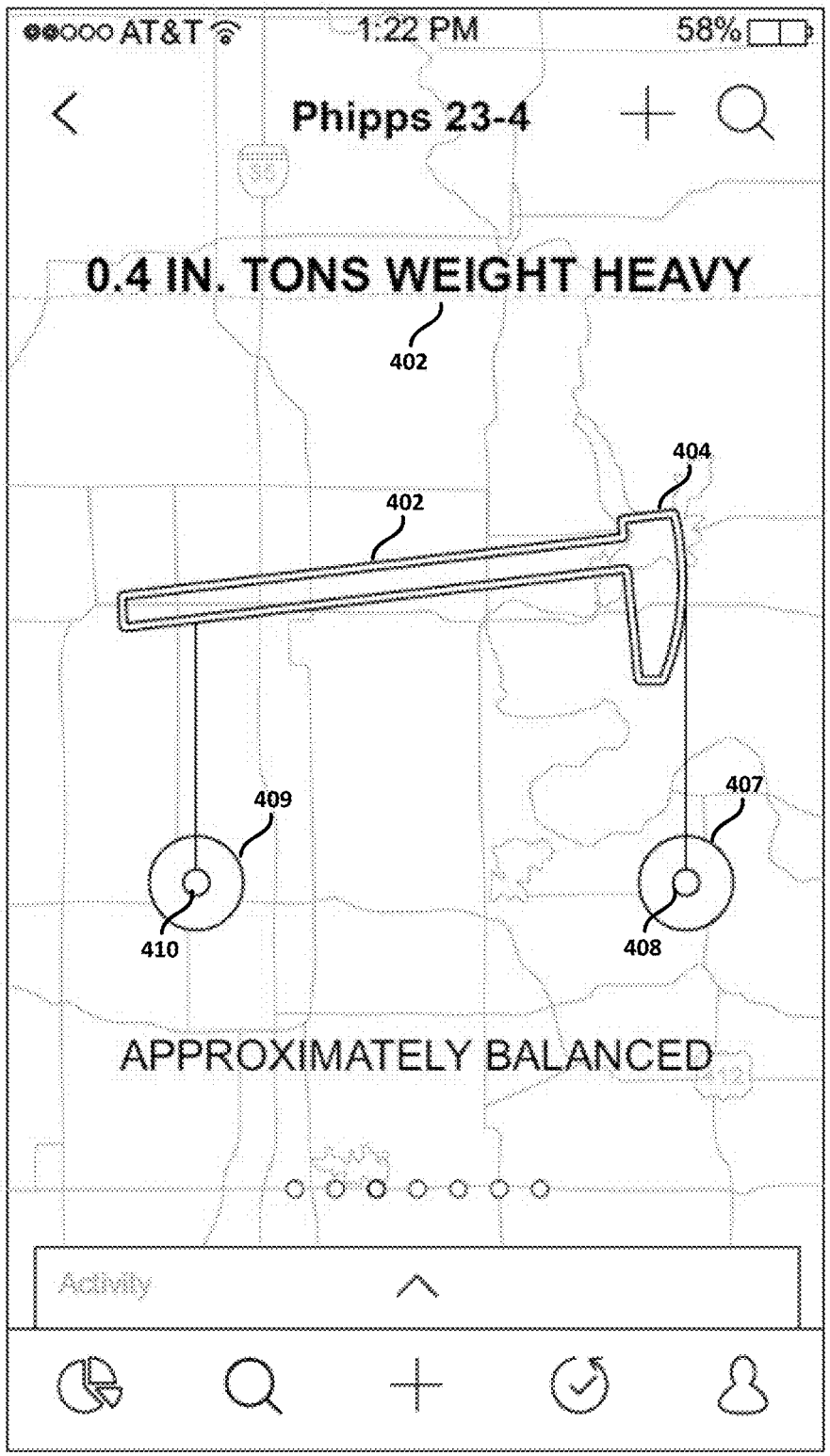
FIG. 4 is a diagram illustrating the balance state of a pump jack, as may be visualized on a mobile device, according to one embodiment.

FIG. 4 is a diagram illustrating the balance state of a pump jack, as may be visualized on a mobile device, according to one embodiment. The visualization 400 of FIG. 4 is a way to display the resulting effects of the load acting upon the pumping units cranks and how this translates to the approximate balance of the crank system. Given an estimate of crank load (CL) using estimates of motor torque and inertial torque, the balance of the crank system may be approximated, according to one embodiment, by subtracting the average load in a region around 90° from the average load around 270°.

By design, the counter weights and the weight of the rod and horse head play a crucial role in the balance of the pumping unit. Specifically, the counter weights help lift the rods, the horse's head, and everything else affected by gravity in the upstroke, while under load from positions 0° to 180° of the crank's rotation. Similarly, those roles reverse during the downstroke, effectively just lifting the counter weights from positions 180° to 360° of the crank's rotation. Therefore, at the 90° and 270° positions of the crank's rotation, the counter weight effects are most impactful and it is at these positions that the differences in approximate max crank torques (or effort the machine is performing) may be calculated to interpret the balance of the machine.

This analysis may observe three different states of balance according to the mechanics and calculation described in the previous paragraph; namely, "rod heavy", "weight heavy" and/or "approximately balanced". Indeed, if the effort on the upstroke is larger than the effort on the downstroke then this implies that the counter weights are not providing a large enough effect and pumping unit is working more on the upstroke. The balance of the pump unit may, therefore, be characterized as being "rod heavy", as shown at 502 in FIG. 5. If the effort on the downstroke is larger than the effort on the upstroke, then this implies that the counter weights are providing too large of an effect and pumping unit is working more on the downstroke. The balance of the pump unit may, therefore, be characterized as being "weight heavy", as shown at 402 in FIG. 4. If, however, the effort on the upstroke is approximately equal to the effort on the downstroke then this implies that the counter weights are providing the right amount of effect on the balance of the pumping unit. The balance of the pump unit may, therefore, be characterized as being "approximately balanced", as shown in both FIGS. 4 and 5. It is to be noted that the effort on the upstroke may approximately equal to the effort on the downstroke, but it is never exactly equal and in some cases companies purposefully run their pumps to be slightly rod heavy for specific purposes. Therefore, although slightly "rod heavy" or slightly "weight heavy", the pump unit may still be characterized as being "approximately balance". Selectable thresholds may be defined to define the range of imbalances that may still be characterized as "approximately balanced".

Figure 5:
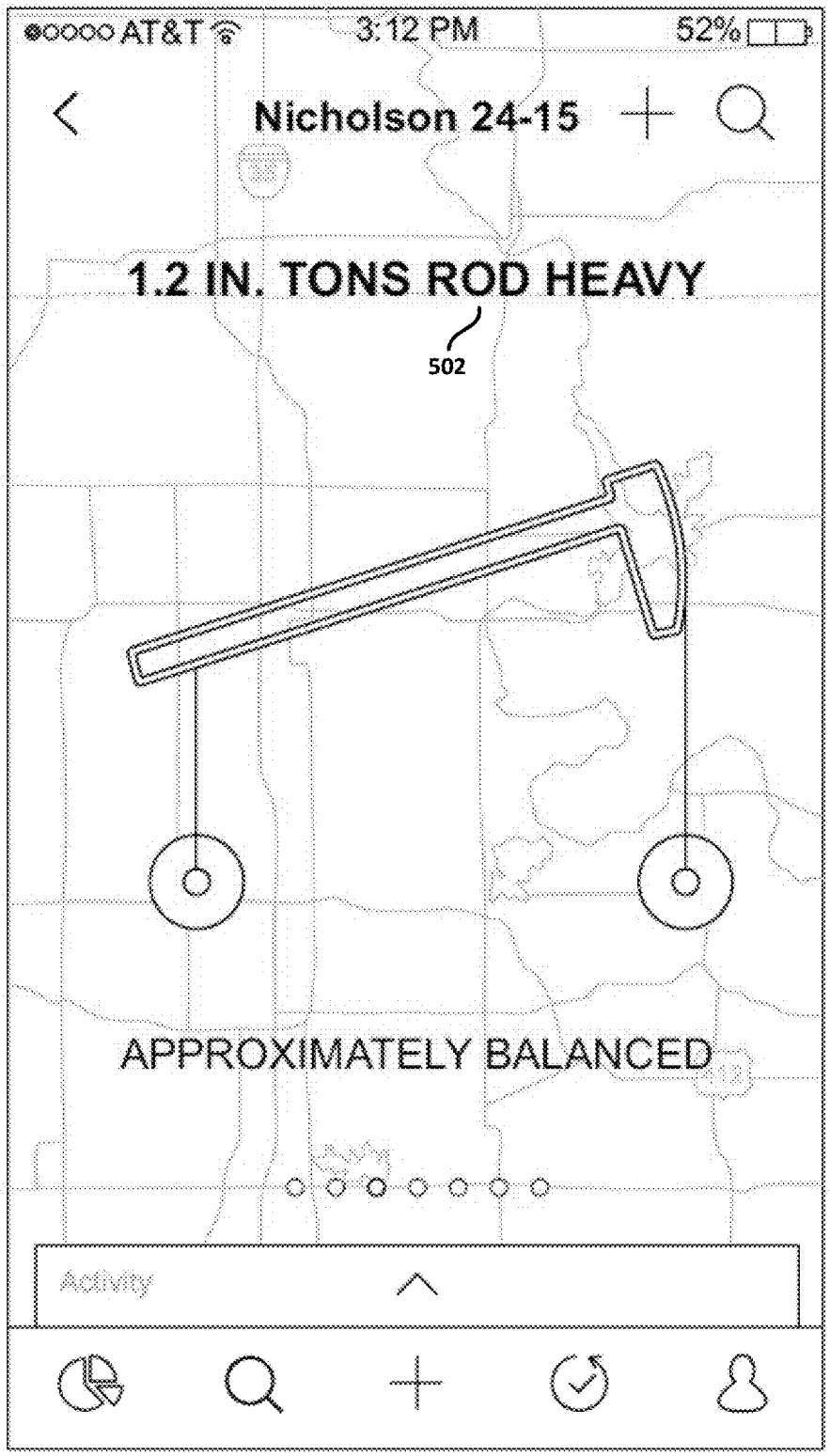
FIG. 5 is another diagram illustrating the balance state of a pump jack, as may be visualized on a mobile device, according to one embodiment.

As shown in FIGS. 4 and 5, the balance state of the pump jack may be displayed for the user in the form of dynamic animation and text on a mobile device app, in one embodiment. The animation, according to one embodiment, may be configured to display a walking beam 402 and horse head 404 pivoted on an invisible fulcrum point and moving up and down. This is essentially replicating the pump jack motion of a full stroke with the speed of the animation driven by the real-time computed stroke rate. According to one embodiment, at both ends of the walking beam and horse head, vertical lines may be provided, leading to two dots 408, 410 centered within respective highlighted circular regions 407, 409, respectively, of variable sizes. According to one embodiment, the size of the enclosing circular regions 407 may be driven, in one embodiment, by the real-time computed torque at that point. Specifically, the dot 408 below the horse's head refers to the approximate maximum crank torque computed to lift the rods, the horse's head, and everything else affected by gravity through the upstroke, while under load, and the enclosed circular region 407 may be configured, according to one embodiment, to shrink or grow depending upon the real or near real-time computed crank torque. The dot 410 below the opposite end of the beam refers to the approximate maximum crank torque computed to lift the counter weights through the downstroke. The enclosed circular region 409 may also be configured to shrink or to grow depending upon the real or near real-time computed crank torque to lift the counterweights through the downstroke.

The calculated difference, in inch-tons . . .

$$\max(CT_{@90})-\max(CT_{@270})$$

. . . may be displayed in inch-tons and is displayed at the top of the graphic, as shown at 402. The numerical value displayed is the absolute value of the calculated difference. If this difference is positive, then the balance may be characterized as "rod heavy" and if it is negative then the balance may be characterized as being "weight heavy". Small positive or negative differences may be ignored and the "rod heavy" or "weigh heavy" labels may be applied only if the absolute difference is greater than a predetermined or user-selectable threshold. Indeed, if the calculated difference is within a small window about zero, the pump may be accurately characterized as being "approximately balanced". If the calculated difference falls outside this range in either direction, the pump unit may be reported to be out of balance in either the "rod heavy" or "weight heavy" directions.

According to one embodiment, the calculated difference may be computed for approximate max crank torques about the 90° and 270° position of the cranks. Specifically, using a linear model of effective load on the pumping unit, motor current RMS data, and crank acceleration data, calculated differences may be computed in approximate max motor torque and approximate max inertial torque to determine this final well balance value. By setting specific checkpoints, warnings may be sent out upon the occurrence of any extreme or out of acceptable range observations of the pump card's movement.

Bridle Abnormality Detection

Figure 6:
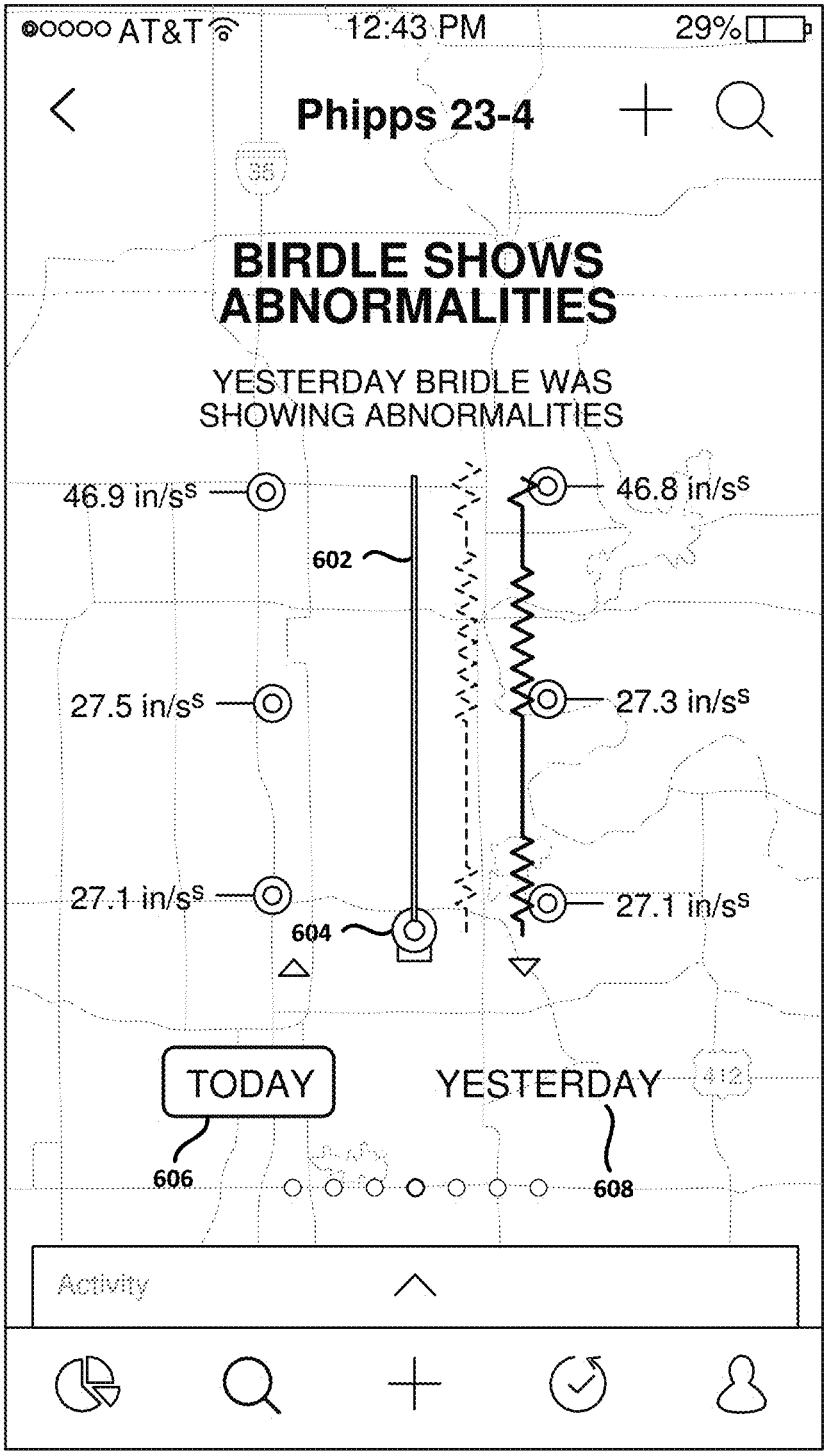
FIG. 6 is a diagram illustrating observed bridle pump jack abnormalities, as may be visualized on a mobile device, according to one embodiment.

According to one embodiment, visualizations such as shown at 600 in FIG. 6 may be provided to display changes in acceleration of the bridle through the upstroke and downstroke motion of the pumping unit. According to one embodiment, a sensor box containing an accelerometer (a 6-axis IMU, for example) may be readily attached to the polished rod or bridle to capture the accelerometer time series data. With this bridle information and the information concurrently captured by sensors coupled to the crank, the pumping unit's stroke phase may be identified. This enables the sensors from both locations to be synchronized. In turn, such synchronization enables exact correlations between the crank angle, the bridle movement, and stroke percentage (the percentage of the pumping unit's full stroke has been completed, where beginning=0% and the end of the full stroke=100%) to be generated.

The synchronization allows the detailed motion of the bridle to be known, enabling a knowledge of its position along its up and down movement throughout the stroke. Then, using the associated accelerometer time series data, changes in bridle acceleration over time can be detected and significant "pops" or abnormalities from a smooth movement along its path detected and recorded.

Figure 7:
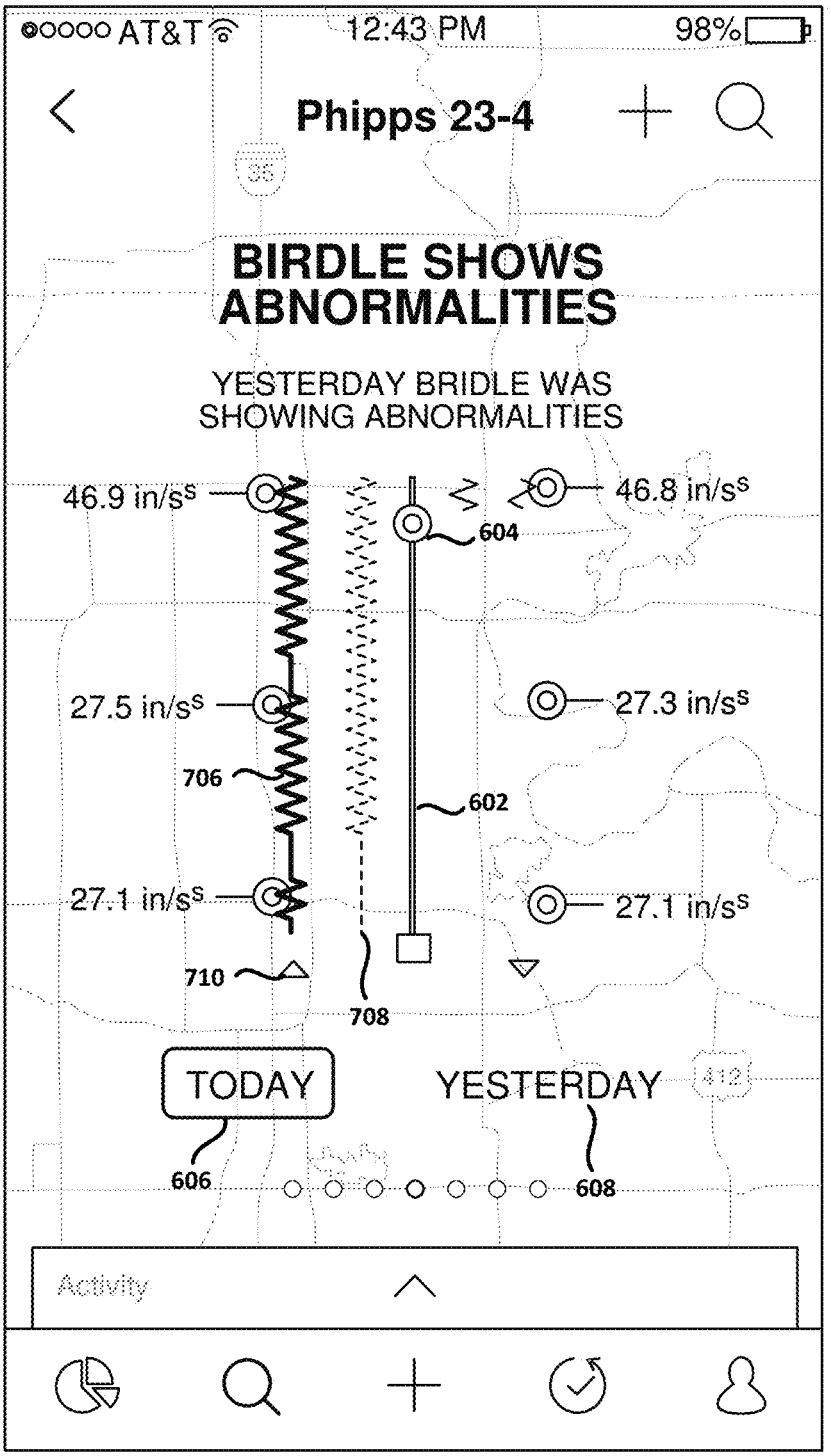
FIG. 7 is another diagram illustrating observed bridle pump jack abnormalities, as may be visualized on a mobile device, according to one embodiment.

According to one embodiment, repeated observations of bridle movement may be used to construct a typical or nominal acceleration profile of bridle movement. The average deviation from this typical acceleration profile over the stroke position may be recorded, over many strokes. The inclination of the bridle may be estimated by computing the angle between the estimated principal axis of acceleration with the estimated gravity vector. The accelerometer data may be combined with gyroscopic data to get an accurate estimate of the gravity vector. Corrections may be made for estimated bias by computing a bootstrapped measurement error, among other possible corrections. According to one embodiment, bridle abnormality data so obtained may be displayed using a bold center line 602 with a dot 604 moving up and down the bold center line 602. The dot 604, in this manner, may represent the bridle sensor while the solid line 602 may represent the bridle sensor's path (up and down) through a course of a full stroke. The dot begins at the bottom of the bold center line, denoting the 0° position of the crank and the beginning of the upstroke. As the pumping unit runs through the upstroke, the dot 604 may be caused to move up the bold center line 602, while at the same time a bold line 706 and a dashed line 608 on the left are traced out, as shown in FIG. 7. These represent the values in the calculated change of acceleration on the up stroke (denoted by the arrow 710 pointing up at the bottom of the traced lines), where the bold line 706 shows the current calculations and the dashed line 708 shows the last recorded calculations. A small value (approximately zero) is denoted as a straight line, while a larger value (denoting a specific change in acceleration) is denoted by a squiggle or zig-zag in the traced line and a shaking movement of the sensor dot traversing up the solid line. Furthermore, the size of the squiggle and shaking of the dot 604 may be driven, according to one embodiment, by the calculated data value, which may also be displayed to the left of the line and pointing to the specific region of its occurrence.

Figure 8:
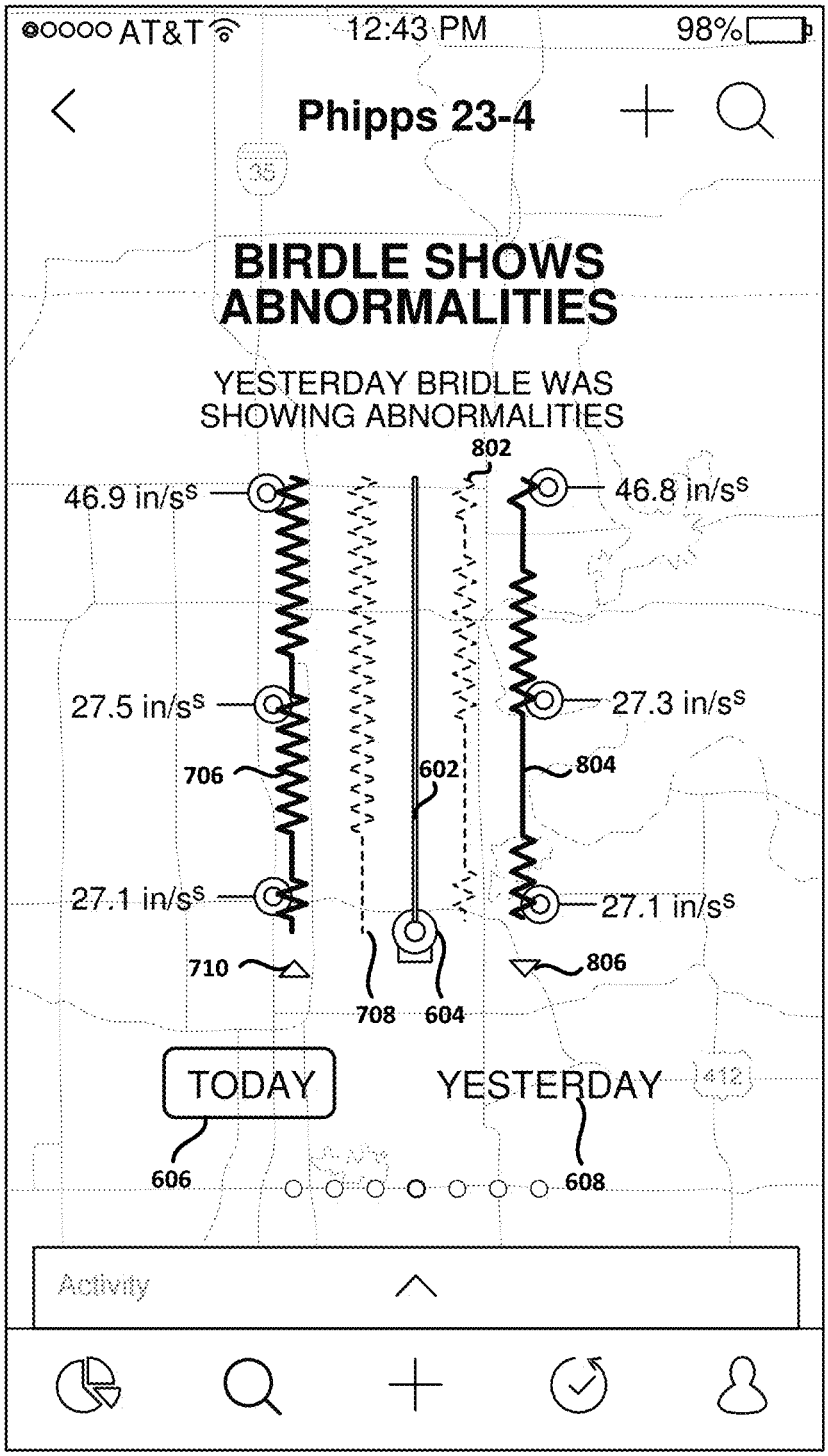
FIG. 8 is yet another diagram illustrating observed bridle pump jack abnormalities, as may be visualized on a mobile device, according to one embodiment.

Upon the completion of an upstroke and the beginning of the downstroke, the dot proceeds to move down the solid line 602 and a similar visual analysis of the change in acceleration may be displayed on the right side of the screen, as shown in FIG. 8. This downstroke portion of the stroke and the bridle's movement may be denoted by the arrow 806 pointing downward at the bottom, along with the same squiggle and shaking movements of the animated dot and traced lines. That is, the values in the calculated change of acceleration on the downstroke are also shown, where the bold line 804 shows the current calculations and the dashed line 808 shows the last recorded calculations. As discussed relative to FIG. 7, a small value (approximately zero) is denoted as a straight line, while a larger value (denoting a specific change in acceleration) is denoted by a squiggle or zig-zag in the traced line and a shaking movement of the sensor dot 604 traversing down the solid line. Furthermore, the size of the squiggle and shaking of the dot 604 may be driven, according to one embodiment, by the calculated data value, which may also be displayed to the right of the line and pointing to the specific region of its occurrence.

Figure 9:
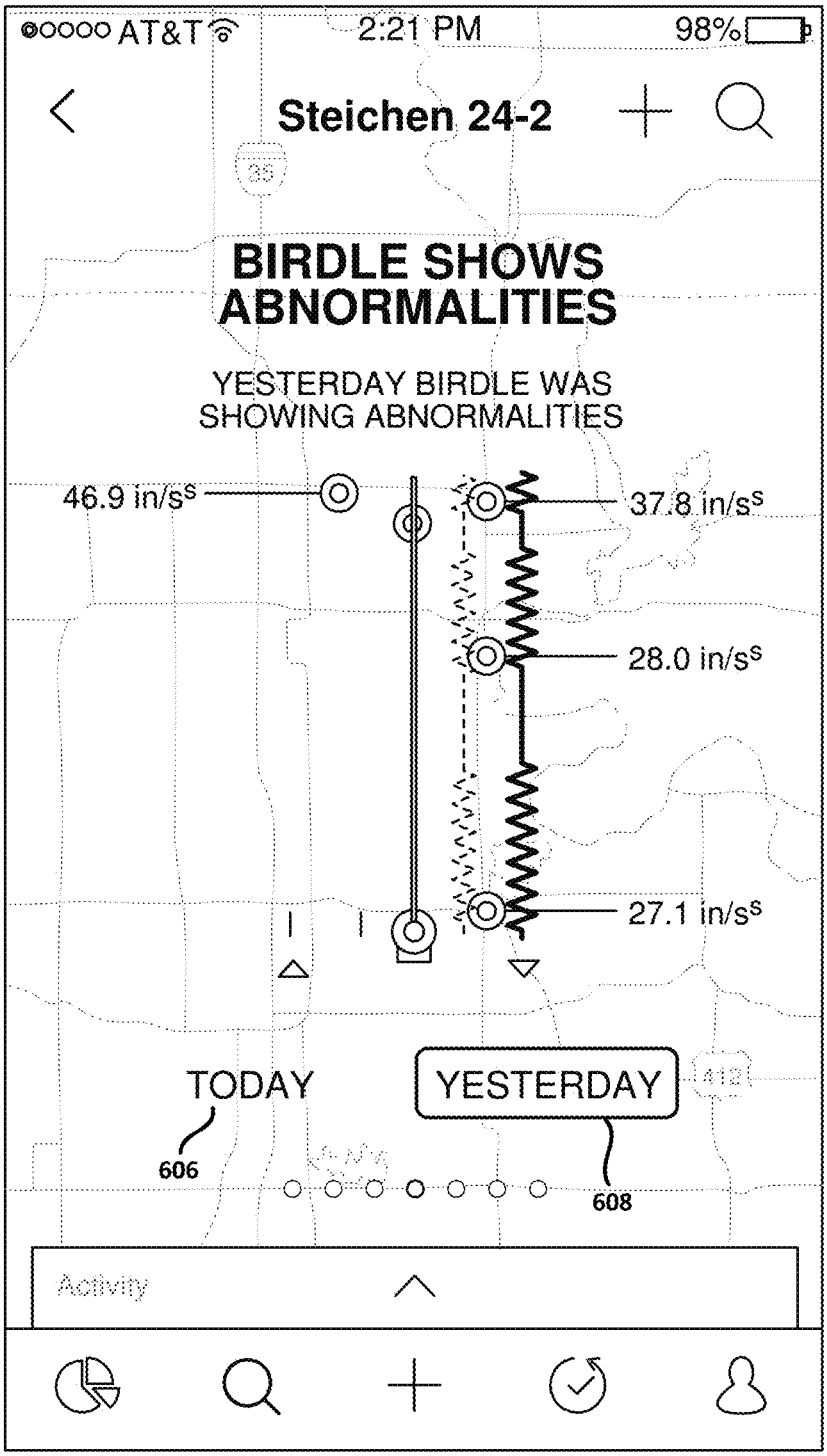
FIG. 9 is a still further diagram illustrating observed bridle pump jack abnormalities, as may be visualized on a mobile device, according to one embodiment.

At the top of the visualization 600 in FIGS. 6, 7 and 8, is an observational statement describing the observed abnormalities in the bridle movement, currently and 24 hours ago. Buttons denoted "TODAY" 606 and "YESTERDAY" 608 may be provided, to show the bridle's operation today and yesterday. Other time frames may be accommodated. As shown in FIG. 9, the "YESTERDAY" display 900 may mirror the "TODAY" display 600, but the recorded data values on the far right and left sides of the screen are associated with the dashed traced lines, pointing to the specific regions of its pop/anomaly occurrences. By setting specific checkpoints, warnings may be generated and sent out (via text message, email or any other form of electronic messaging) upon the occurrence of any extreme or out of acceptable range observations of the bridle's movement.

Stroke Inclination Detection

Figure 10:
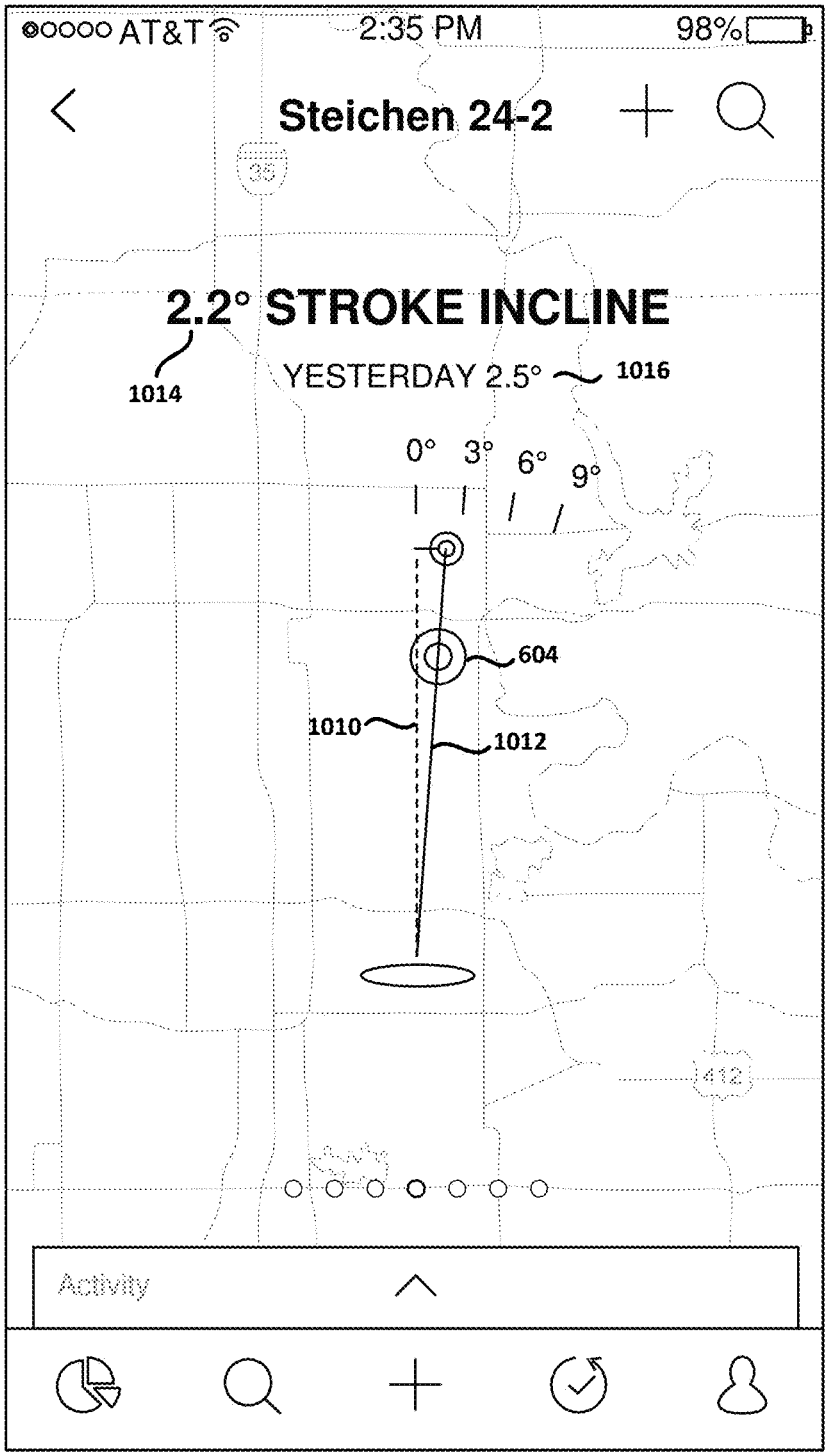
FIG. 10 is a diagram illustrating the observed stroke incline of a pump jack, as may be visualized on a mobile device, according to one embodiment.

The stroke inclination detection visualization or animated graphic 1000 is shown in FIG. 10 and represents an estimated measure of the inclination along the bridle sensor path through a full stroke of the pumping unit. This allows users to maintain insight into the movement of the bridle sensor. By setting specific checkpoints, warnings may be generated and sent out (via text message, email or any other form of electronic messaging) upon the occurrence of any extreme or out of acceptable range observations.

The actual computation of the stroke inclination may be made by the sensor fusion of accelerometer and gyroscope time series data to accurately estimate the gravity vector acting upon the sensor unit. By computing a singular value decomposition of the accelerometer matrix data, centered along its respective axes, and using its principal components, the planar x-y space of the data may be defined. This, in turn, defines the principal axis of acceleration, allowing the angle between this vector and the estimated gravity vector as the angle of inclination to be computed.

The stroke angle may be visualized, according to one embodiment, using an animated graphic. In one embodiment, the animation starts with a solid line to denote the path of the bridle sensor with angles marked at the top of the line. Then the line adjusts itself to the calculated angle of inclination, as shown at 1012, leaving a dashed line 1010 at the zero-degree position. The dot 604, representing the bridle sensor, then begins to move up and down to show the bridle sensor movement through the full stroke of the pumping unit. Furthermore, the speed of the dot 604 is driven by the actual speed of the machine. The measured angle of inclination may be provided in text at the top of the screen, as shown at 1014, while the measured angle of inclination recorded 24 hours ago may be displayed in smaller text just below as shown at 1016, for the purpose of comparison.

Figure 11:
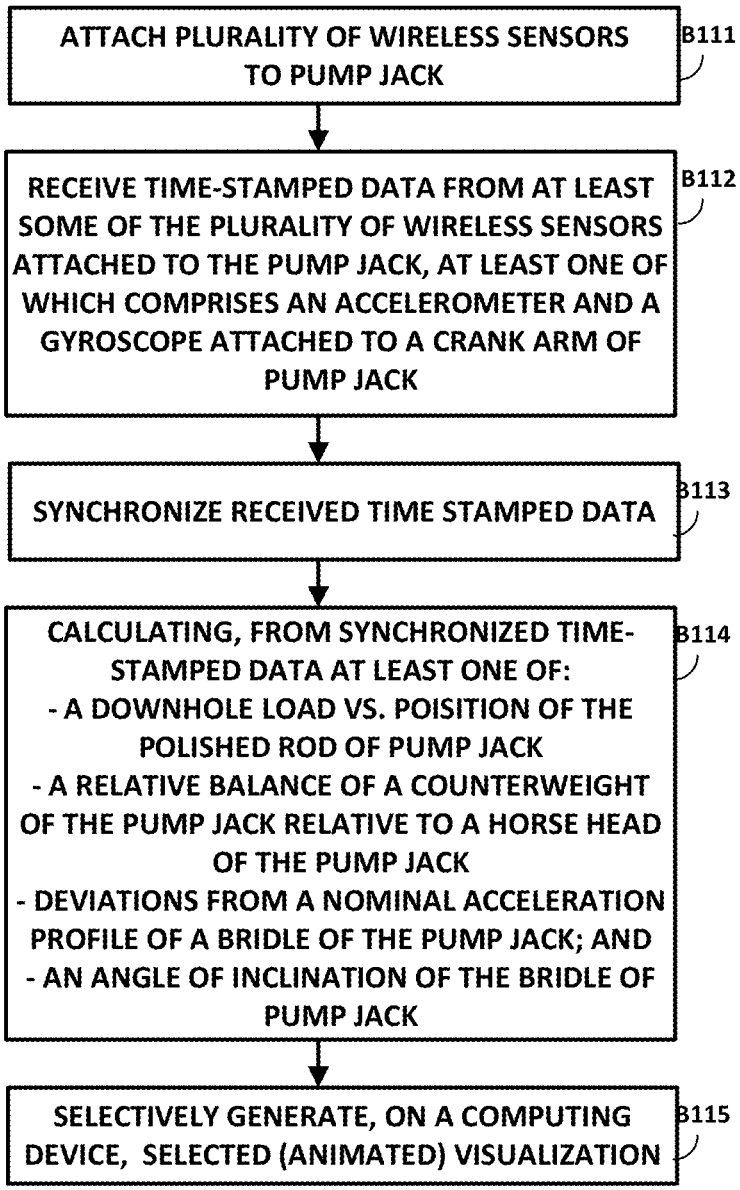
FIG. 11 is a flowchart illustrating aspects of a method according to one embodiment.

FIG. 11 is a flowchart illustrating aspects of a method according to one embodiment. As shown therein, a computer-implemented method, according to one embodiment, may comprise attaching a plurality of wireless sensors to a pump jack, as shown at B111. B112 calls for receiving time-stamped data from one or more of the plurality of wireless sensors attached to the pump jack. According to one embodiment, one or more of the plurality of wireless sensors may comprise, for example, a 6-axis IMU comprising an accelerometer and a gyroscope, attached to a crank arm of the pump jack. As shown at B113, the received time time-stamped data may then be synchronized, according to the time stamps thereof and as shown at B114, from the synchronized time-stamped data, information to the following may be generated, calculated or derived: the downhole load versus polished rod position of the pump jack as shown and described relative to FIGS. 1 and 2; the relative balance of the counterweight of the pump jack relative to a horse head of the pump jack as shown and described relative to FIGS. 4 and 5; deviations from the nominal acceleration profile of the bridle of the pump jack as shown and described relative to FIGS. 6, 7, 8 and 9; and the angle of inclination of the bridle of the pump jack as shown and described relative to FIG. 10, among other information that may be calculated or derived from the synchronized time-stamped data. As shown at B115, selected visualizations may be generated on a computing device, related to one or more of the above.

According to one embodiment, at least some of plurality of wireless sensors may be magnetically and removably attached to selected structures of the pump jack. The plurality of sensors may include accelerometers, gyroscopes, acoustic microphones, pressure sensors, load cells, torque sensors, temperature sensors, flow meters and electrical current sensors.

The downhole load may be calculated, according to one embodiment, using an output of one or more load or pressure sensors. The position of the polished rod may be determined, according to one embodiment, using acoustical output data of at least one microphone. Attaching wireless sensors may comprise, according to one embodiment, attaching one or more of a 6-Axis inertial measurement unit (IMU) comprising at least an accelerometer and a gyroscope to the polished rod of the pump jack; a 6-Axis IMU comprising an accelerometer and a gyroscope to a crank arm of the pump jack; a sensor configured to monitor motor current or to obtain motor current information from a motor controller of the pump jack; a strain gauge configured to measure deflection of the crank arm of the pump jack; and/or a strain gauge configured to measure a deflection of a beam of the pump jack.

According to one embodiment, calculating and generating information related to the downhole load versus the position of polished rod position may comprise generating time series data related to the crank angle of the crank arm of the pump jack. Data from the accelerometer and the gyroscope attached to the crank arm may be combined, according to one embodiment, and a crank angle velocity about a vector that is normal to a plane of rotation of the crank arm may be determined, from the combined accelerometer and gyroscope data. In turn, from the determined crank angle and the crank velocity, one or more of the following may be determined: a stroke percentage of the crank arm, relative to a full stroke of the crank arm; a stroke rate, relative to the crank angle velocity of the crank arm; and/or a stroke rate of change, relative to an angular acceleration of the crank arm. One embodiment may comprise selectively generating the visualization of the generated surface load versus polished rod position information for both current and historical time-stamped data received from wireless sensors attached to the pump jack.

One embodiment may also, from the synchronized time-stamped data, calculate and generate information related to the relative balance of a counterweight of the pump jack relative to a horse head of the pump jack, as shown and described relative to FIGS. 4 and 5. The generated information relative to the balance of the counterweight and the horse head may be rendered, according to one embodiment, as an animated graphic in at least near real-time on the computing device.

One embodiment may comprise attaching at least one wireless sensor to the bridle of the pump jack and calculating and generating information related to changes in acceleration of the bridle. The generated information relative to the changes in acceleration of the bridle may then be rendered as an animated graphic in at least near real-time on the computing device. The method may also comprise determining the nominal acceleration profile of the bridle, determining deviations from the determined nominal acceleration profile and rendering at least the determined deviations on the computing device, as an animated real-time or near-real-time animated computer graphic. One embodiment may also further comprise determining the angle of inclination of the bridle and rendering the determined inclination as an animated graphic in at least near real-time on the computing device.

According to one embodiment, an electronic message (e.g., text, email, etc.) may be generated and sent, over a computer network, upon an occurrence of an out-of-acceptable-range quantity generated from the received time-stamped data.

While certain embodiments of the disclosure have been described, these embodiments have been presented by way of example only, and are not intended to limit the scope of the disclosure. Indeed, the novel methods, devices and systems described herein may be embodied in a variety of other forms. Furthermore, various omissions, substitutions and changes in the form of the methods and systems described herein may be made without departing from the spirit of the disclosure. The accompanying claims and their equivalents are intended to cover such forms or modifications as would fall within the scope and spirit of the disclosure. For example, those skilled in the art will appreciate that in various embodiments, the actual physical and logical structures may differ from those shown in the figures. Depending on the embodiment, certain steps described in the example above may be removed, others may be added. Also, the features and attributes of the specific embodiments disclosed above may be combined in different ways to form additional embodiments, all of which fall within the scope of the present disclosure. Although the present disclosure provides certain preferred embodiments and applications, other embodiments that are apparent to those of ordinary skill in the art, including embodiments which do not provide all of the features and advantages set forth herein, are also within the scope of this disclosure. Accordingly, the scope of the present disclosure is intended to be defined only by reference to the appended claims.

The invention claimed is:

1. A pump jack system, comprising:

a prime mover;

a gear reducer coupled to the prime mover;

a crank arm coupled to the gear reducer at one end of the crank arm;

a counterweight disposed at another end of the crank arm;

a pitman arm coupled to the crank arm;

a walking beam coupled to the pitman arm;

a horse head coupled to the walking beam and configured to pivot about a fulcrum of a Samson post;

a bridle and polished rod coupled to the horse head;

a plurality of wireless sensors attached to the pump jack, at least one of the plurality of wireless sensors being attached to the crank arm and comprising an accelerometer and a gyroscope, at least some of the plurality of wireless sensors being configured to generate time-stamped data; and a computing device configured to receive and synchronize the time-stamped data and, from the synchronized time-stamped data, calculate and generate information related to a downhole load versus a position of the polished rod, and generate a visualization of the generated information related to the downhole load versus the position of the polished rod.

2. The pump jack system of claim 1, wherein at least some of the plurality of wireless sensors are configured to magnetically and removably attach to the pump jack.

3. The pump jack system of claim 1, wherein the plurality of wireless sensors includes at least one of an accelerometer, a gyroscope, an acoustic microphone, a pressure sensor, a load cell, a torque sensor, a temperature sensor, a flow meter and an electrical current sensor.

4. The pump jack system of claim 1, wherein the computing device is further configured to calculate the downhole load from an output of at least one load or pressure sensor.

5. The computer-implemented method of claim 1, wherein the computing device is further configured to determine the polished rod position from an acoustical output of at least one microphone.

6. The pump jack system of claim 1, wherein the plurality of wireless sensors comprises at least one of:

a 6-Axis inertial measurement unit (IMU) comprising at least an accelerometer and a gyroscope to the polished rod of the pump jack;

a 6-Axis IMU comprising an accelerometer and a gyroscope to a crank arm of the pump jack;

a current sensor configured to monitor motor current or to obtain motor current information from a motor controller of the pump jack;

a strain gauge configured to measure deflection of the crank arm of the pump jack; and a strain gauge configured to measure a deflection of a beam of the pump jack.

7. The pump jack system of claim 1, wherein the computing device is further configured to generate time series data related to a crank angle of a crank arm of the pump jack.

8. The pump jack system of claim 7, wherein the computing device is further configured to combine data from the accelerometer and the gyroscope attached to the crank arm and to determine, from the combined accelerometer and gyroscope data, a crank angle velocity about a vector that is normal to a plane of rotation of the crank arm.

9. The pump jack system of claim 8, wherein the computing device is further configured to determine, from the crank angle and the crank velocity, at least one of:

a stroke percentage of the crank arm, relative to a full stroke of the crank arm;

a stroke rate, relative to the crank angle velocity of the crank arm; and a stroke rate of change, relative to an angular acceleration of the crank arm.

10. The pump jack system of claim 9, wherein the computing device is further configured to selectively generate the visualization of the generated surface load versus polished rod position information for current and historical time-stamped data received from at least some of the plurality of wireless sensors attached to the pump jack.

11. The pump jack system of claim 1, wherein the computing device is further configured to calculate and generate, from the synchronized time-stamped data, information related to a relative balance of a counterweight of the pump jack relative to a horse head of the pump jack.

12. The pump jack system of claim 10, wherein the computing device is further configured to render the generated information relative to the balance of the counterweight and the horse head as an animated graphic in at least near real-time on the computing device.

13. The pump jack system of claim 1, wherein the plurality of wireless sensors further comprises at least one wireless sensor to a bridle of the pump jack, and wherein the computing device is further configured to calculate and generate information related to changes in acceleration of the bridle.

14. The pump jack system of claim 13, wherein the computing device is further configured to render the generated information relative to the changes in acceleration of the bridle as an animated graphic in at least near real-time on the computing device.

15. The pump jack system of claim 14, wherein the computing device is further configured to determine a nominal acceleration profile of the bridle, determine deviations from the determined nominal acceleration profile and render at least the determined deviations on the computing device.

16. The pump jack system of claim 13, wherein the computing device is further configured to determine an angle of inclination of the bridle and render the determined inclination as an animated graphic in at least near real-time on the computing device.

17. The pump jack system of claim 1, wherein the computing device is further configured to generate and send, over a computer network, an electronic message upon an occurrence of an out-of-acceptable-range quantity generated from the received time-stamped data.

18. A pump jack system, comprising:

a pump jack, comprising:

a prime mover;

a gear reducer coupled to the prime mover;

a crank arm coupled to the gear reducer at one end of the crank arm;

a counterweight disposed at another end of the crank arm;

a pitman arm coupled to the crank arm;

a walking beam coupled to the pitman arm;

a horse head coupled to the walking beam and configured to pivot about a fulcrum of a Samson post;

a bridle and polished rod coupled to the horse head;

a plurality of wireless sensors to a pump jack;

a computing device coupled to the plurality of wireless sensors and configured to:

receive time-stamped data from at least some of the plurality of wireless sensors, at least one of the plurality of wireless sensors comprising an accelerometer and a gyroscope and being attached to the crank arm;

synchronize the received time-stamped data;

from the synchronized time-stamped data, calculate and generate information related to:

a downhole load versus polished rod position of the pump jack;

a relative balance of a counterweight of the pump jack relative to a horse head of the pump jack;

deviations from a nominal acceleration profile of a bridle of the pump jack; and an angle of inclination of the bridle of the pump jack; and selectively generate, on the computing device, visualizations of the generated information.

19. The pump jack system claim 18, wherein the visualizations comprise computer graphics that are animated in at least near real-time by changes in the received time-stamped data.

20. The pump jack system claim 18, wherein the computing device is further configured to generate and to send, over a computer network, an electronic message upon an occurrence of an out-of-acceptable-range quantity generated from the received time-stamped data.

* * * * *